US010689068B2

(12) United States Patent
Chang

(10) Patent No.: US 10,689,068 B2
(45) Date of Patent: Jun. 23, 2020

(54) HOLDING HOLE STRUCTURE ON SHIP SIDE

(71) Applicant: MLRB SDN. BHD, Sarawak (MY)

(72) Inventor: Ting-Wei Chang, New Taipei (TW)

(73) Assignee: MLRB SDN, BHD, Sarawak (MY)

( * ) Notice: Subject to any disclaimer, the term of this patent is extended or adjusted under 35 U.S.C. 154(b) by 0 days.

(21) Appl. No.: 16/125,057

(22) Filed: Sep. 7, 2018

(65) Prior Publication Data

US 2020/0079474 A1 Mar. 12, 2020

(51) Int. Cl.
*B63B 17/00* (2006.01)
*B63B 7/08* (2020.01)

(52) U.S. Cl.
CPC ..... *B63B 7/085* (2013.01); *B63B 2017/0054* (2013.01)

(58) Field of Classification Search
CPC ..... B63B 7/085; B63B 2017/0054; B63B 2221/08
See application file for complete search history.

(56) References Cited

U.S. PATENT DOCUMENTS

| | | | | |
|---|---|---|---|---|
| 3,076,668 | A * | 2/1963 | Famely | F16L 5/027 285/137.11 |
| 4,836,127 | A * | 6/1989 | Wille | A01K 97/10 114/343 |
| 7,146,923 | B2 * | 12/2006 | Polley | B63B 7/00 114/345 |
| 8,640,377 | B2 * | 2/2014 | Baltes | A01K 97/10 114/364 |
| 2007/0163480 | A1 * | 7/2007 | Cotton | B63B 13/02 114/197 |
| 2009/0092385 | A1 * | 4/2009 | Cullen | G03B 17/08 396/25 |

* cited by examiner

*Primary Examiner* — Anthony D Wiest
(74) *Attorney, Agent, or Firm* — Pro-TECHTOR International Services; Ian Oglesby

(57) ABSTRACT

A holding hole structure on ship side comprising: an inner ring, wherein there is a first outer flange on the top; wherein the said first outer flange is set in the middle area of an external surface of a ship; and a cylindrical through hull fitting, of which the top and the said inner ring are knocked together; wherein the external surface of a ship-and the cylindrical through hull fitting are connected by the inner ring, wherein the cylindrical through hull fitting is made of material like stainless steel for improving strength of the cylindrical through hull fitting as well as increasing the linking force between the inner ring and the external surface of a ship, thus the load bearing of the cylindrical through hull fitting is improved, Thereby it is achieved that a fix buckle, a light stand buckle, a flagpole or a fishing rod can be held on the ship side.

3 Claims, 6 Drawing Sheets

HOLDING HOLE STRUCTURE ON SHIP SIDE

TECHNICAL FIELD

The present invention relates to an improvement in a holding hole structure on a ship side, particularly to a holding hole structure on a ship side for increasing strength of a cylindrical through hull fitting, as well as linking force between an inner ring and an external surface of a ship, whereby objects like a flagpole, and a fishing rod are conveniently held on the ship side.

BACKGROUND ART

Nowadays foam material is used as stuffing for a boat, which has the advantage of high strength and bearing of high load. Even it is damaged, water cannot leak into an external surface of a ship. Hence it is often applied to lifeboats, transport boats and fishing boats.

At the side of a boat, there is at least a holding hole seat, for setting a flagpole, a fishing rod and so on. A conventional holding hole seat normally comprises an inner ring and an outer ring, wherein the outer ring is extending at the bottom and thereby building up a cylindrical through hull fitting; wherein the inner ring and outer ring are screwed together, whereby an external surface of a ship is pressed between the inner ring and the outer ring. Thereby it is achieved that the cylindrical through hull fitting is set in an external surface of a ship for holding flagpole, fishing rod and so on.

A conventional inner ring and cylindrical through hull fitting are formed mostly in one piece made of PVC. However, heat resistance and strength of the cylindrical through hull fitting made of PVC are limited. During injecting foam material into the ship side layer, the cylindrical through hull fitting can become deformed or broken.

Besides, since fixing of the inner ring in the external surface of a ship is only possible through connection with the outer ring, the inner ring and the cylindrical through hull fitting are pressed in the ship side layer, as soon as the outer ring is taken down, while the external surface of a ship is still not filled with foam material.

In view of these disadvantages the inventor performed continuous testing and improvement and developed the present invention.

SUMMARY OF THE INVENTION

The main object of the present invention is to provide a holding hole structure on ship side for holding a flagpole, fishing rod and others.

For achieving above object, the present invention comprises: an inner ring, wherein there is a first outer flange on the top; wherein the said first outer flange is set in the middle area of the external surface of a ship; and a cylindrical through hull fitting, which is fastened to the inner ring at the top.

Preferably, inside the inner ring, there is a first inner thread for setting cylindrical through hull fitting and/or other parts.

Preferably, the inner ring is connected with an external reinforcement ring; wherein outside the external reinforcement ring there is a first outer thread and on the top a third outer flange; wherein the first outer thread is screwed with the first inner thread of the inner ring, hence the external surface of a ship is pressed between the first outer flange of the inner ring and the third outer flange of the external reinforcement ring. Thereby the linking force between the inner ring and external surface of a ship is increased, thus the load bearing of the cylindrical through hull fitting is improved.

Preferably, inside the external reinforcement ring there is a second inner thread, connected with a cylindrical through hull fitting fixing ring; wherein outside the cylindrical through hull fitting fixing ring there is a second outer thread; wherein the second outer thread is screwed with the second inner thread of the external reinforcement ring and the bottom of the cylindrical through hull fitting fixing ring is withstanding the top of the cylindrical through hull fitting, whereby the cylindrical through hull fitting is fastened.

Preferably, on the top of the cylindrical through hull fitting fixing ring there is a fourth outer flange; wherein on the top of the fourth outer flange there is a convex-concave structure for rotating the cylindrical through hull fitting fixing ring to fasten the cylindrical through hull fitting.

Preferably, on the middle of the inner ring there is a first inner flange; on the top of the cylindrical through hull fitting there is a second outer flange; after the cylindrical through hull fitting has passed through the inner ring, the second outer flange is fastened to the first inner flange. Thereby the cylindrical through hull fitting and the inner ring are fastened together conveniently.

Preferably, at the bottom of the inner ring there is a second inner flange; the inside diameter of the second inner flange is slightly larger than the outer diameter of the cylindrical through hull fitting, so that strength of the cylindrical through hull fitting is improved.

The inner ring is sticking with a sticking layer; wherein the sticking layer is covering the inner ring from the bottom, and the sticking layer is sticking fixed on middle area of the external surface of a ship, whereby the inner ring and the cylindrical through hull fitting are fixed in the external surface of a ship stably.

Other aspects and advantages of the present invention will become apparent from the following detailed description, taken in conjunction with the accompanying drawing, illustrating by way of example the principles of the present invention.

DETAILED DESCRIPTION OF PREFERRED EMBODIMENTS

Figure 1:
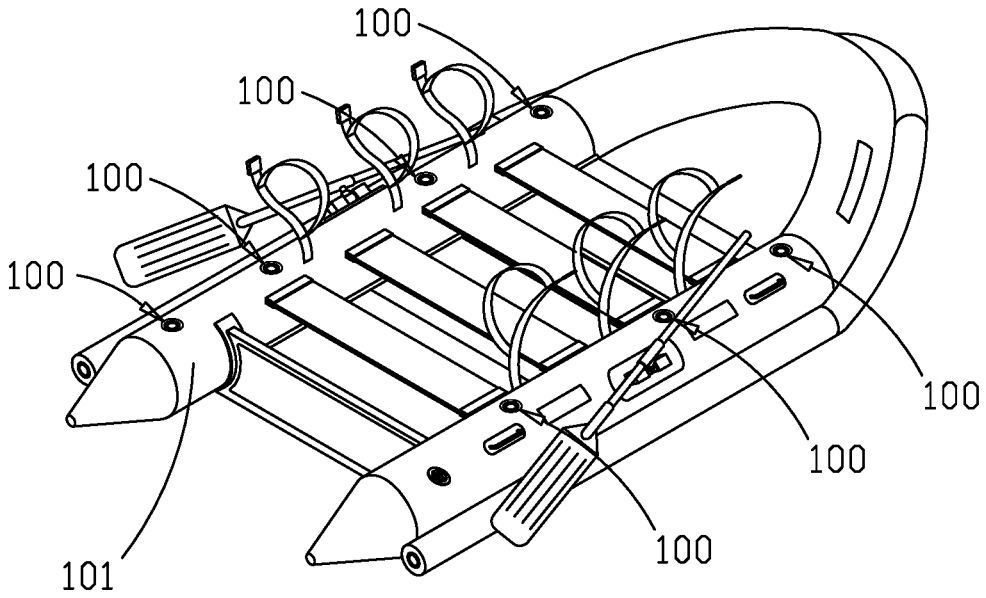
FIG. 1. shows the present invention applied to an external surface of a ship.
Figure 2:
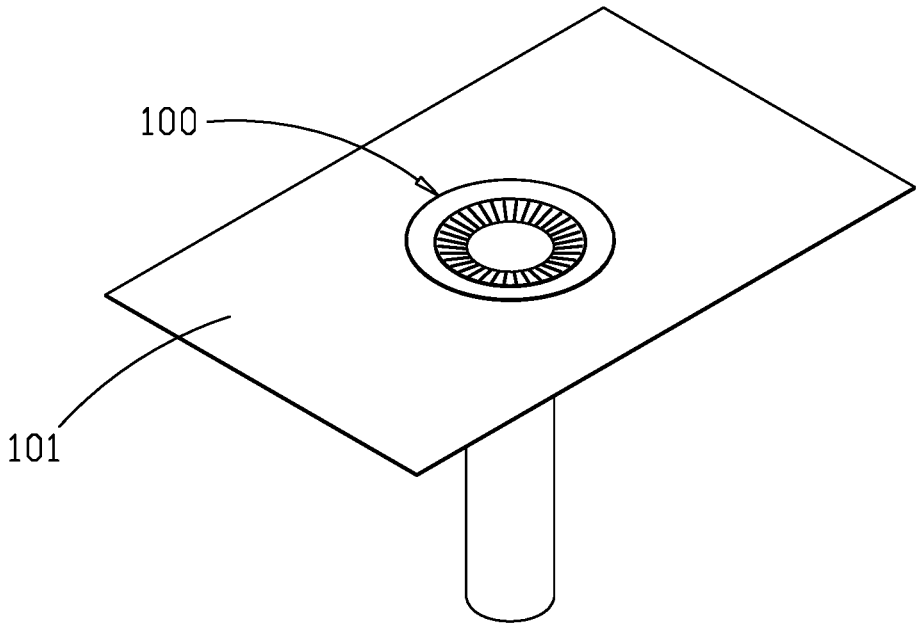
FIG. 2. shows an external surface of a ship assembled with the present invention.
Figure 3:
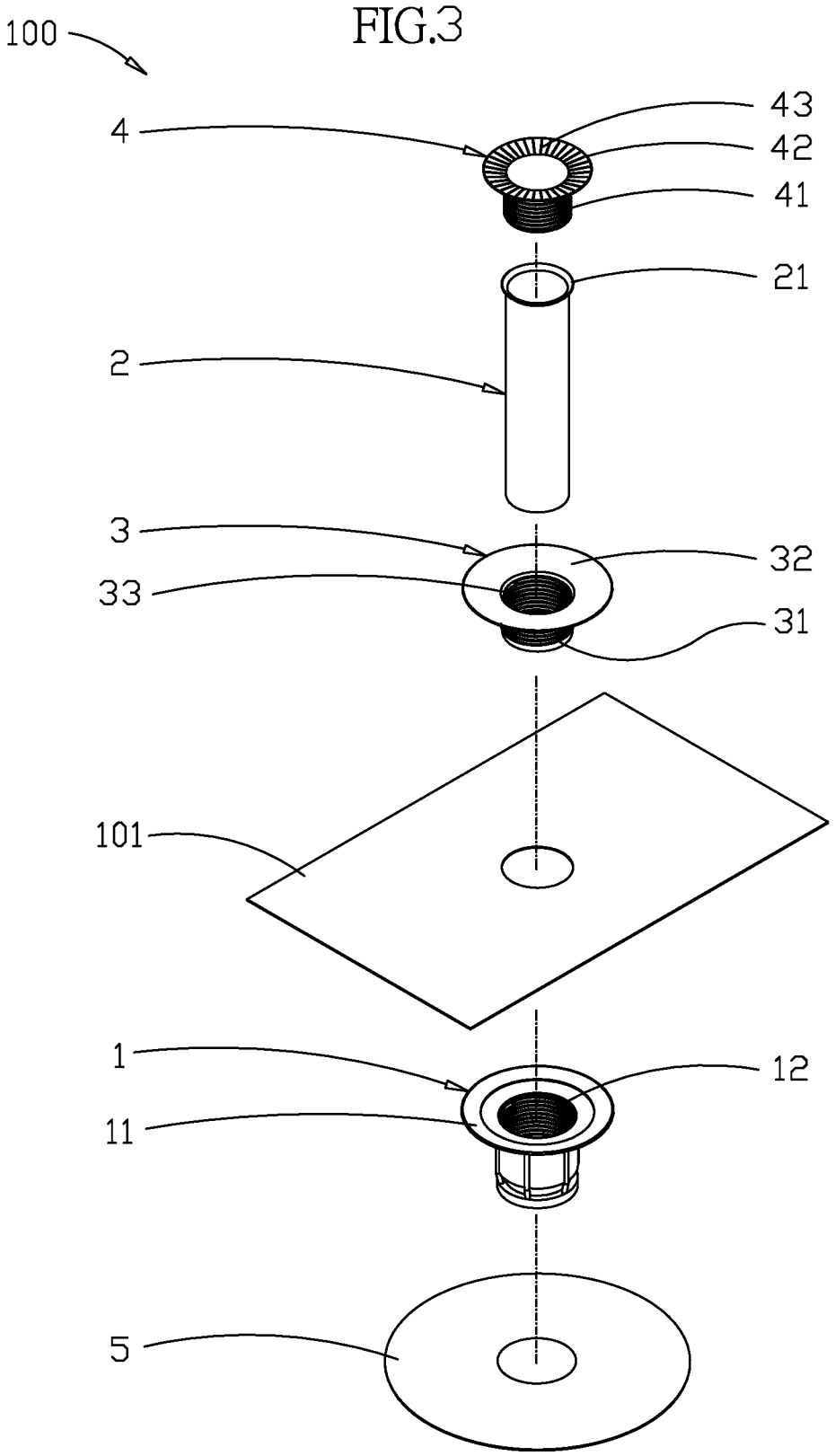
FIG. 3. is an exploded view of the present invention

As shown in FIG. 1-3, the present invention a holding hole structure on ship side 100 comprises: an inner ring 1, having a first outer flange 11 on the top; wherein the first outer flange 11 is set in the middle area of an external surface of a ship-101; and a cylindrical through hull fitting 2, of which the top is fastened to the inner ring 1; an external surface of a ship-101 and the cylindrical through hull fitting 2 are connected through the inner ring 1, wherein the cylindrical through hull fitting 2 is made of material like stainless for increasing strength of the cylindrical through hull fitting 2, and improving the linking force between the inner ring 1 and the external surface of a ship-101. Thereby it is achieved, that objects like flagpole, fishing rod are hold on the ship side.

On the top of the inner ring 1 there is a first outer flange 11, for connecting the external surface of a ship 101. The first outer flange 11 is set in the middle area of the external surface of a ship 101, to extend its contact area with the external surface of a ship-101, thereby the fiction between the inner ring 1 and the external surface of a ship 101 is increased, furthermore the inner ring and the catheter are fixed in the external surface of a ship stably. For saving cost, an inner ring of the gas nozzle of a conventional ship side can be used as the inner ring 1.

Since the top of the cylindrical through hull fitting 2 is fastened to the inner ring 1 together, the catheter is fixed with the inner ring 1 together in the external surface of a ship 101, to hold such like fixing buckle seat, lamp holder, flagpole, fishing rod and so on. Thereby it is achieved, that fixing buckle seat, lamp holder, flagpole, fishing rod and so on are set in the ship side conveniently.

Figure 4:
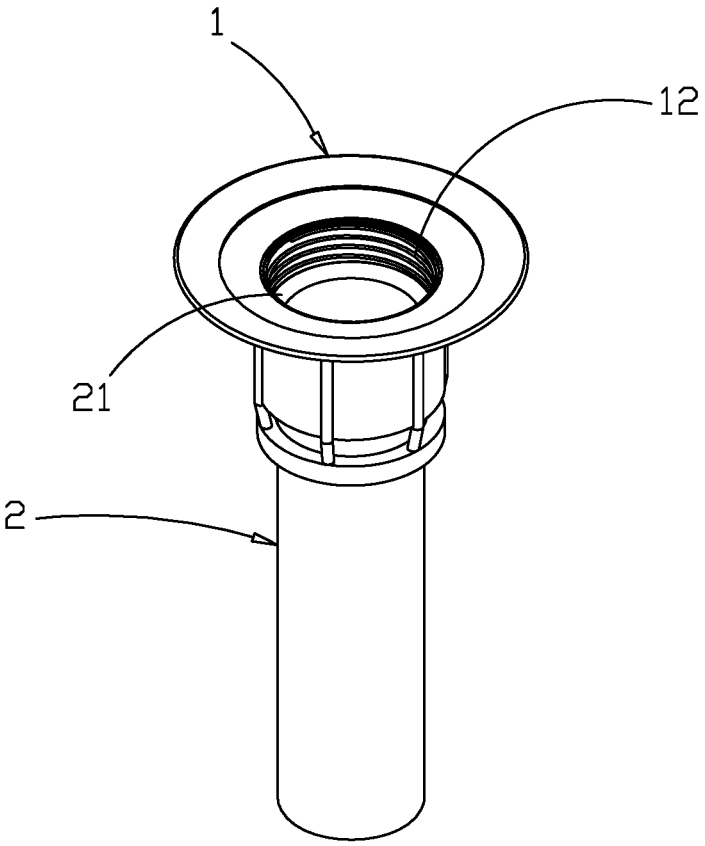
FIG. 4. shows the cylindrical through hull fitting of the present invention fastened to the inner ring.

As shown in FIG. 3-4, the cylindrical through hull fitting 2, which is detachably fastened to the inner ring 1, is made of material other as the inner ring 1, therefore it can be made of material with higher strength, like stainless steel for increased heat resistance and strength, thus deformation or rupture cannot happen, during filling foam material in the external surface of a ship-101.

Inside the inner ring 1 there is a first inner thread 12, for connecting an external reinforcement ring 3. Outside of the external reinforcement ring 3 there is a first outer thread 31, and on the top a third outer flange 32, wherein the first outer thread 31 is set in the first inner thread 12 of the inner ring 1, whereby the external surface of a ship-101 is pressed between the first outer flange 11 of the inner ring 1 and the third outer flange 32 of the external reinforcement ring 3. Thereby the linking force between the inner ring 1 and the external surface of a ship 101 is increased, furthermore the load bearing of the cylindrical through hull fitting 2 is improved.

Figure 5:
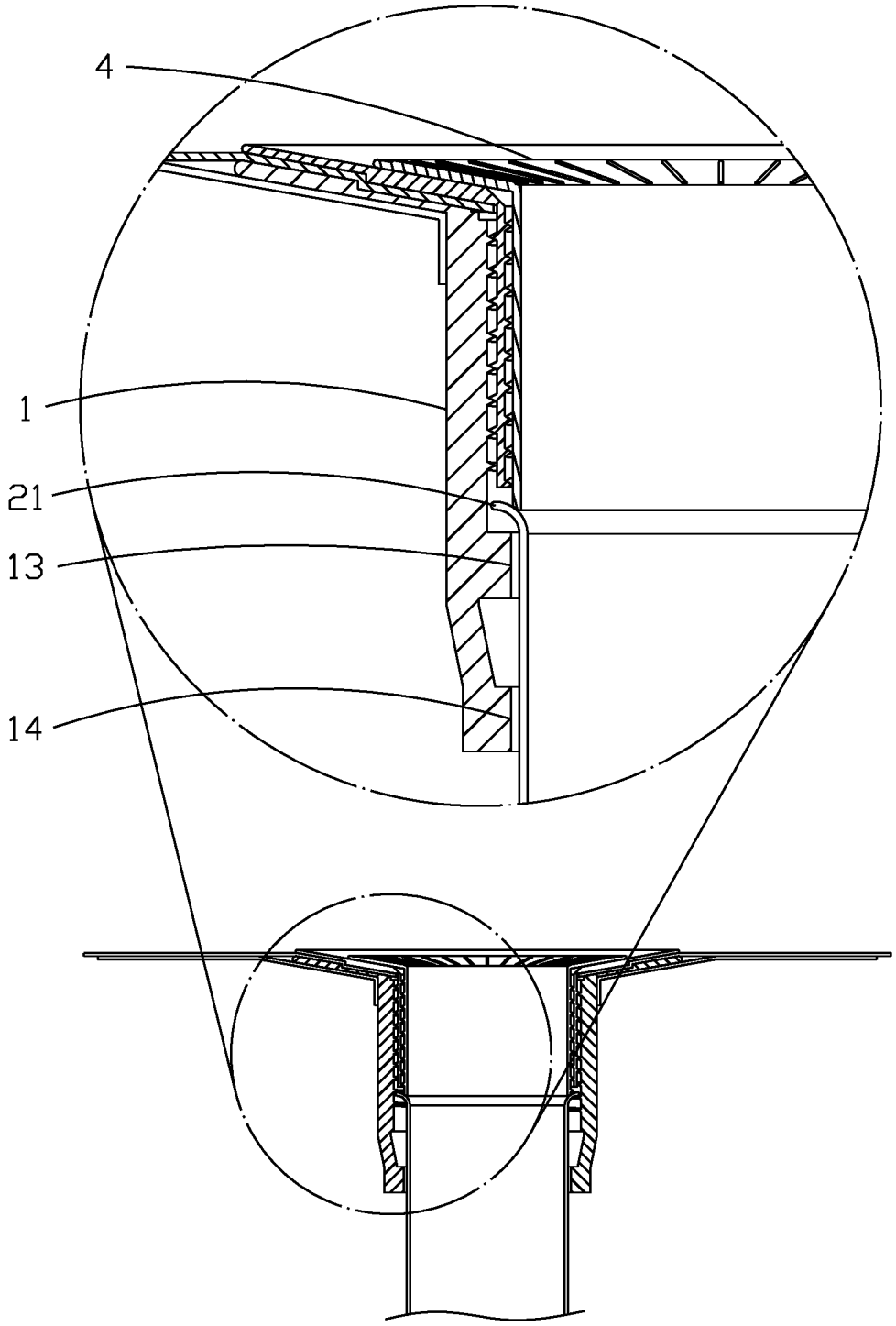
FIG. 5. is a sectional view of the present invention set in an external surface of a ship FIG. 6. shows the present invention and the inner ring are fixed with a sticking layer.

As shown in FIG. 3-5, on the middle of the inner ring 1 there is a first inner flange 13, while on the top of the cylindrical through hull fitting 2 there is a second outer flange 21. After the bottom of the catheter passing through the inner ring 1, the second outer flange 21 is seats against the first inner flange 13, thus the cylindrical through hull fitting 2 is fastened to the inner ring 1 together.

Inside the external reinforcement ring 3 there is a second inner thread 33, which is further connected with a cylindrical through hull fitting fixing ring 4. Outside the cylindrical through hull fitting fixing ring 4 there is a second outer thread 41. The second outer thread 41 is screwed with the second inner thread 33 of the external reinforcement ring 3, and the bottom of the cylindrical through hull fitting fixing ring 4 is withstanding the top of the cylindrical through hull fitting 2 to fix the cylindrical through hull fitting 2. Thereby the cylindrical through hull fitting 2 is fixed.

On the top of the cylindrical through hull fitting fixing ring 4 there is a fourth outer flange 42. At the top of the fourth outer flange 42 there is a convex-concave structure 43, for rotating the catheter fixing ring to fix the catheter.

At the bottom of the inner ring 1 there is a second inner flange 14. A predetermined distance is set up between the second inner flange 14 and the first inner flange 13. The inside diameter of the second inner flange 14 is larger than the outer diameter of the cylindrical through hull fitting 2, whereby oblique of the cylindrical through hull fitting 2 is avoided. Thereby strength of the catheter is improved.

Figure 6:
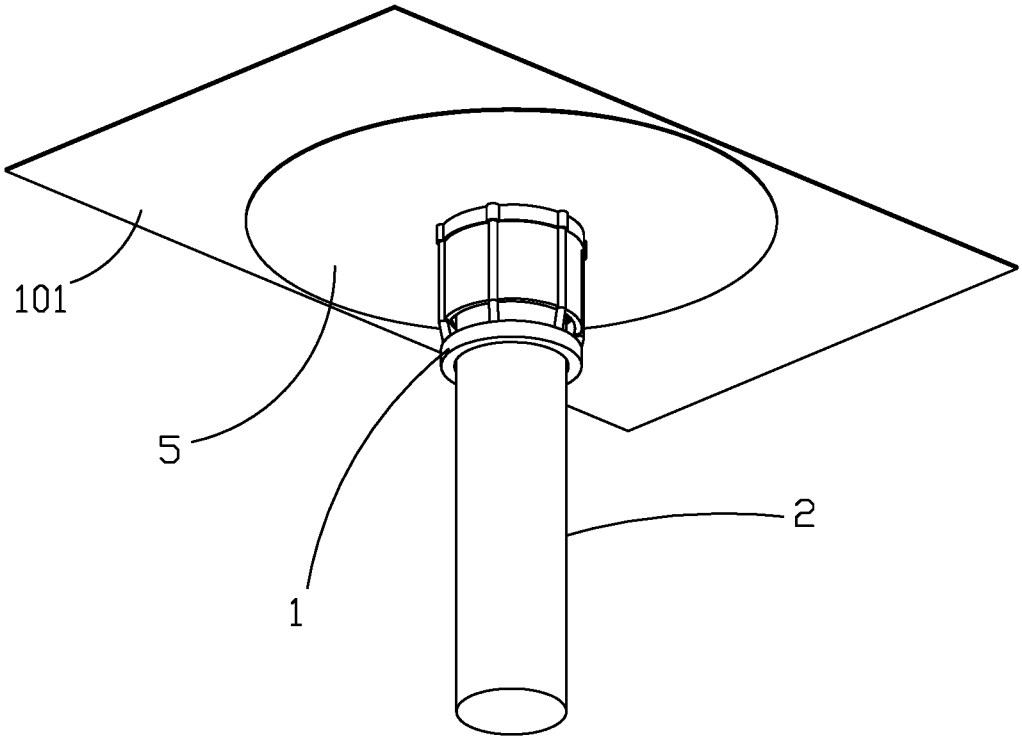

As shown in FIG. 6, the first outer flange 11 of the inner ring 1 is further connected with a sticking layer 5. The sticking layer 5 is covering the inner ring 1 from the bottom, and it is glued on middle area of the external surface of a ship 101. Thereby the inner ring 1 and the cylindrical through hull fitting 2 are fixed in the external surface of a ship stably.

While preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

The invention claimed is:

1. A holding hole structure on an external surface of a ship comprising:

an inner ring, having a first outer flange on a top; wherein the first outer flange is set in a middle area of an external surface of a ship; and a cylindrical through hull fitting having a second outer flange on a top thereof, the cylindrical through hull fitting being fastened to the inner ring;

wherein inside the inner ring there is a first inner thread;

wherein the inner ring is connected with an external reinforcement ring; wherein outside the external reinforcement ring there is a first outer thread and at the top a third outer flange; wherein the first outer thread is screwed with the first inner thread of the inner ring, whereby the external surface of a ship is pressed between the first outer flange of the inner ring and the third outer flange of the external reinforcement ring.

2. The holding hole structure on an external surface of a ship as claim 1, wherein inside the external reinforcement ring there is a second inner thread connected with a cylindrical through hull fitting fixing ring; wherein outside the cylindrical through hull fitting fixing ring there is a second outer thread; wherein the second outer thread is screwed with the second inner thread of the external reinforcement ring and the bottom of the cylindrical through hull fitting fixing ring is extending through the top of the cylindrical through hull fitting.

3. The holding hole structure an external surface of a ship as claim 2, wherein on the top of the cylindrical through hull fitting fixing ring there is a fourth outer flange; wherein on a top of the fourth outer flange there is a concave-convex structure.

* * * * *